US006193860B1

(12) United States Patent
Weling

(10) Patent No.: US 6,193,860 B1
(45) Date of Patent: Feb. 27, 2001

(54) METHOD AND APPARATUS FOR IMPROVED COPPER PLATING UNIFORMITY ON A SEMICONDUCTOR WAFER USING OPTIMIZED ELECTRICAL CURRENTS

(75) Inventor: Milind Weling, San Jose, CA (US)

(73) Assignee: VLSI Technolgy, Inc., San Jose, CA (US)

( * ) Notice: Subject to any disclaimer, the term of this patent is extended or adjusted under 35 U.S.C. 154(b) by 0 days.

(21) Appl. No.: 09/298,629

(22) Filed: Apr. 23, 1999

(51) Int. Cl.[7] ..... C25B 9/04
(52) U.S. Cl. ..... 204/230.2
(58) Field of Search ..... 204/230.2, 230.7, 204/280; 205/96

(56) References Cited

U.S. PATENT DOCUMENTS 3,437,578 * 4/1969 Gibbs et al. ..... 204/230.7
3,573,175 * 3/1971 Bedi ..... 205/118
3,880,725 * 4/1975 Van Raalte et al. ..... 205/95
4,043,891 * 8/1977 Alkire et al. ..... 204/231
4,828,654 * 5/1989 Reed ..... 205/97

FOREIGN PATENT DOCUMENTS

95782 * 2/1996 (IE) .
1046874 * 10/1983 (SU) .

OTHER PUBLICATIONS

James E. Brady and Gerard E. Humiston, "Fourth Edition: General Chemistry: Principles and Structure" Chapter 17 Electrochemistry, 1986 No month available.

* cited by examiner

*Primary Examiner*—Kathryn Gorgos
*Assistant Examiner*—Erica Smith-Hicks
(74) *Attorney, Agent, or Firm*—Wagner, Murabito & Hao LLP

(57) ABSTRACT

An apparatus for optimizing electrical currents to improve copper plating uniformity on a semiconductor wafer is disclosed. The use of multiple anodes of the embodiment provides for variable electrical currents to the semiconductor wafer, the variable feature of the variable electrical currents compensating for non-uniform electroplating characteristics.

24 Claims, 6 Drawing Sheets

METHOD AND APPARATUS FOR IMPROVED COPPER PLATING UNIFORMITY ON A SEMICONDUCTOR WAFER USING OPTIMIZED ELECTRICAL CURRENTS

TECHNICAL FIELD

The field of the present invention pertains to semiconductor fabrication processes. More particularly, the present invention relates to the field of electroplating a copper film on the surface of a semiconductor wafer.

BACKGROUND ART

Semiconductor wafers use layers of semiconductor material, insulator material, and conductor material to build up integrated circuit patterns. These different layers can be formed by chemical vapor deposition, electroplating, or other means. For the specific use of bulk copper for next generation copper-based interconnects, the increasingly popular method of application is electroplating.

Referring to Prior Art FIG. 1A a top view of a prior art electrochemical cell used for electroplating a semiconductor wafer is presented. Similarly, Prior Art FIG. 1B is a side view of a prior art electrochemical cell presented in Prior Art FIG. 1A. The structure of the electrochemical cell will be explained herein. The electrochemical cell is typically constructed of a chamber 104 that encloses the balance of the electrochemical cell apparatus. In the cell is a semiconductor wafer 102 that acts as a cathode in the electrochemical operation. A copper anode 106 is disposed a distance away from semiconductor wafer 102. The semiconductor wafer 102 is coupled to leads 112. Similarly, copper anode 106 is coupled to leads 114. In between the anode 106 and semiconductor wafer 102 is a copper sulfate solution that fills chamber 104. The solution provides metal molecules in a liquid suspension. The subsequent electrical voltage and electrical current 108 applied across anode 106 and semiconductor wafer 102 cathode motivate the metal molecules to dissociate into metal ions which leave the solution to adhere to the semiconductor wafer 102 that acts as the cathode. The result is a deposited layer of film 116 composed of the metal that was previously in solution. More specifically, the film is a copper film 116.

Despite its popularity however, electroplating has several drawbacks. First, electroplating is a wet processing technique that is very sensitive to process variations. Consequently, the resulting copper film 116 has a thickness and surface that is uneven and inconsistent. Considering the tight tolerances involved in semiconductor wafer fabrication, a need exists to improve the crude and loosely controlled process of electroplating. More specifically, a need exists to control the variability of electroplating such that the plated metal film has an even and consistent thickness and surface.

One important variable in the plating process is the electrical current that drives the electroplating process. Because electrical current provides the driving force to propel metal ions in suspension towards the semiconductor wafer 102 cathode, controlling the variation in the electrical current will do much to control the thickness and uniformity of the electroplated metal film. Hence, a need arises for a method and apparatus that can reduce the variation in the electric field that drives the electroplating operation.

While the electric current may appear to be constant across the entire area spanned between the anode and the electrode, because a constant voltage is applied across both electrodes, in reality, the electrical current is not constant. Many factors, individually and together, alter and distort a theoretically constant electrical current that exists across the anode and cathode.

Some of the factors that alter and distort the electrical current include: variables changing over elapsed time of the electroplating operation; voltage variation across the semiconductor wafer 106 cathode; variation in the profile of anode 106 used in the electroplating operation; distortion caused by the chamber 104 housing the electrochemical operation; changes in the thickness of metal film 116 electroplated onto semiconductor wafer 102; and the electrical characteristics of the metal solution used in the electroplating operation. More specifically, temporal and voltage variations arise from sources such as changes to the metal solution conductivity, reduction of the resistivity of the semiconductor wafer cathode 106 as plated copper overtakes the copper seed layer, etc. Likewise, chamber 104 of electrochemical cell 100 may have an effect on the electrical current distribution. These and other examples illustrate the many sources of distortion on a theoretically constant electric current flux.

As an analytic example of the variation of the electrical current, a theoretical current used in a commercial electroplating cell would be calculated per:

$$I=(V*A)/(t*p);$$

where $A=\text{area}=\pi r^2$ t=distance between anode and cathode

ρ=resistivity of metal solution used in the electroplating operation

V=applied voltage across the cathode/ anode

By examining this equation, it is apparent that many factors can influence the resulting current calculation. For example, the distance between anode and cathode can vary due to erosion of the profile of the anode or due to thickness variations in the plated surface for the semiconductor wafer cathode. Many other similar such influences can be derived.

One way to improve the electroplating process, in view of these sensitivities, is to reduce the variations noted above. While this is possible, some variables are very difficult to control while others becomes exponentially difficult to control as their tolerances decrease. Consequently, a need arises for an apparatus and a method that will compensate for the variations in the electrical current and in other variables altering and distorting the electrical current for the electroplating operation.

In summary, a need exists for a method and system for improving the crude and loosely controlled process of electroplating. More specifically, a need exists to control the variable of electroplating such that the plated metal film has an even and consistent thickness and surface. Furthermore, a need arises for a method and an apparatus that can reduce the variation in the electric current distribution that drives the electroplating operation. Specifically, a need arises for an apparatus and a method that will compensate for the variations in the electrical current and in other variables altering and distorting the electrical current for the electroplating operation.

DISCLOSURE OF THE INVENTION

The present invention provides a method and system for improving the crude and loosely controlled process of electroplating. More specifically, the present invention provides a method and apparatus to control the variables affecting electroplating such that the plated metal film has an even and consistent thickness and surface. Furthermore, the present invention provides a method and an apparatus that can reduce the variation in the electric field that drives the electroplating operation. More specifically, the present invention provides an apparatus and a method that will compensate for the variations in the electrical current and in other variables altering and distorting the electrical current for the electroplating operation.

One embodiment of the present invention includes a method comprising several steps. One step involves placing a semiconductor wafer into an electrochemical cell for an electroplating operation. Another step couples the semiconductor wafer to an electrode. One step dispenses a metallic solution into the electrochemical cell. Finally, a step provides a variable electrical current to the semiconductor wafer, the variable feature of the variable electrical current compensates for nonuniform electroplating characteristics.

Another embodiment of the present invention is a system for electroplating a layer of material on a semiconductor wafer. The system is comprised of an electrochemical cell, at least one secondary anode, a metallic solution, and a power source. The electrochemical cell is comprised of a primary anode, a cathode contact, and a chamber. The primary anode and the cathode contact are disposed within the chamber. The power source, capable of producing the variable current, is coupled to the primary anode, to the secondary anode and to the cathode contact. The second anode, providing a variable current to the semiconductor wafer, is disposed within the chamber of the electrochemical cell. Finally, the metallic solution is disposed within the electrochemical cell.

These and other advantages of the present invention will no doubt become obvious to those of ordinary skill in the art after having read the following detailed description of the preferred embodiments which are illustrated in the drawing figures.

BRIEF DESCRIPTION OF THE DRAWINGS

The accompanying drawings, which are incorporated in and form a part of this specification, illustrate embodiments of the invention and, together with the description, serve to explain the principles of the invention. The drawings referred to in this description should be understood as not being drawn to scale except if specifically noted.

PRIOR ART

PRIOR ART

BEST MODE FOR CARRYING OUT THE INVENTION

Reference will now be made in detail to the preferred embodiments of the invention, a method and apparatus for improving copper plating uniformity on a semiconductor wafer using optimized electrical currents. Example embodiments are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail as not to unnecessarily obscure aspects of the present invention.

Figure 1A:
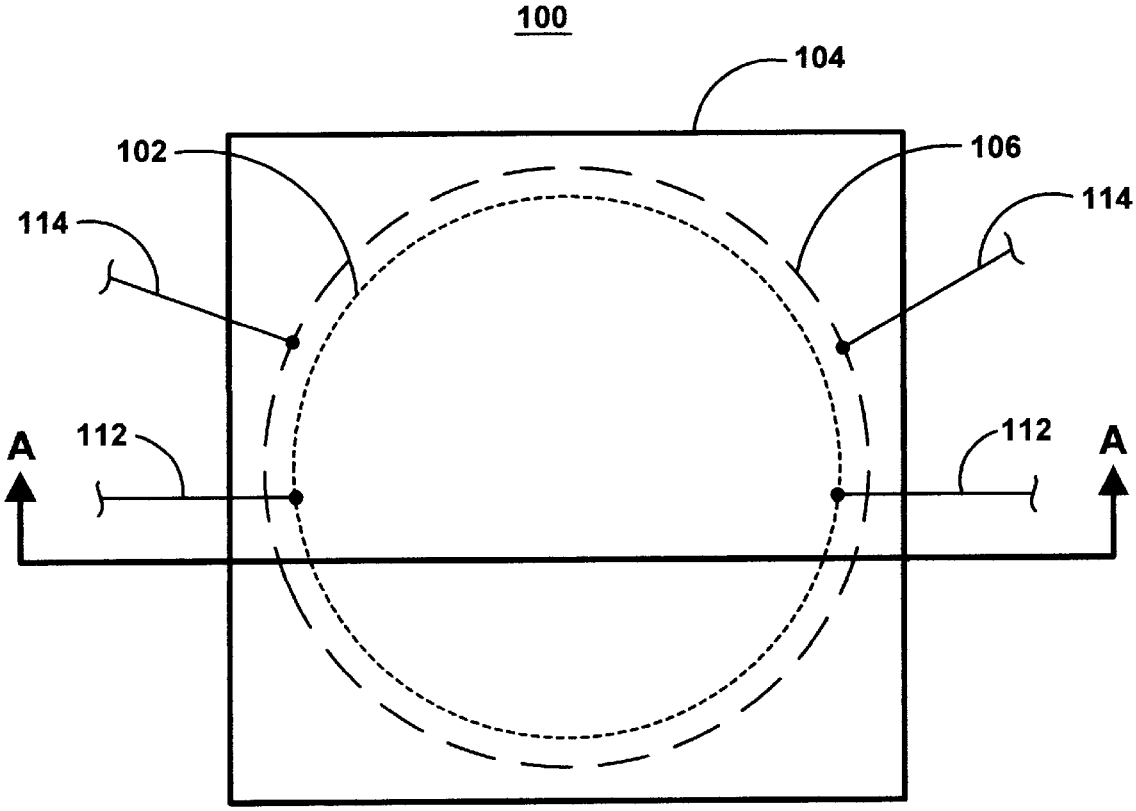
FIG. 1A (Prior Art)
FIG. 1A is a top view of a prior art electrochemical cell used for electroplating a semiconductor wafer.
Figure 1B:
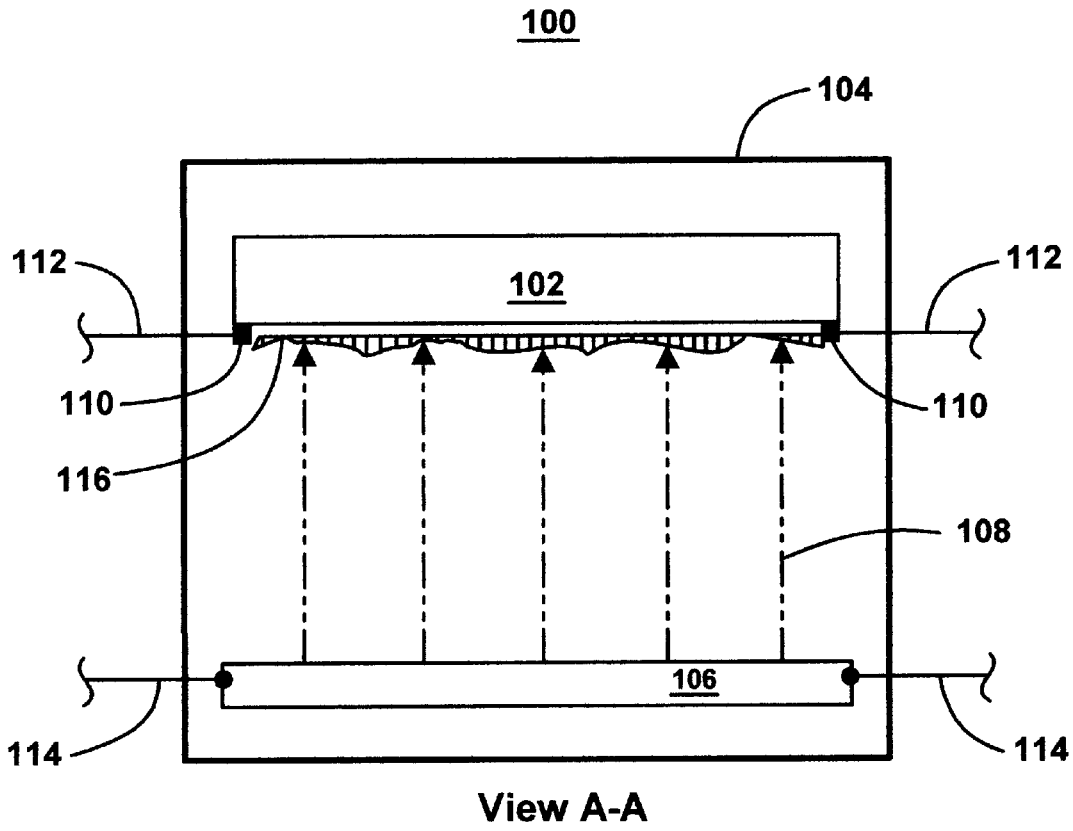
FIG. 1B (Prior Art)
FIG. 1B is a side view of a prior art electrochemical cell presented in Prior Art FIG. 1A.
Figure 2A:
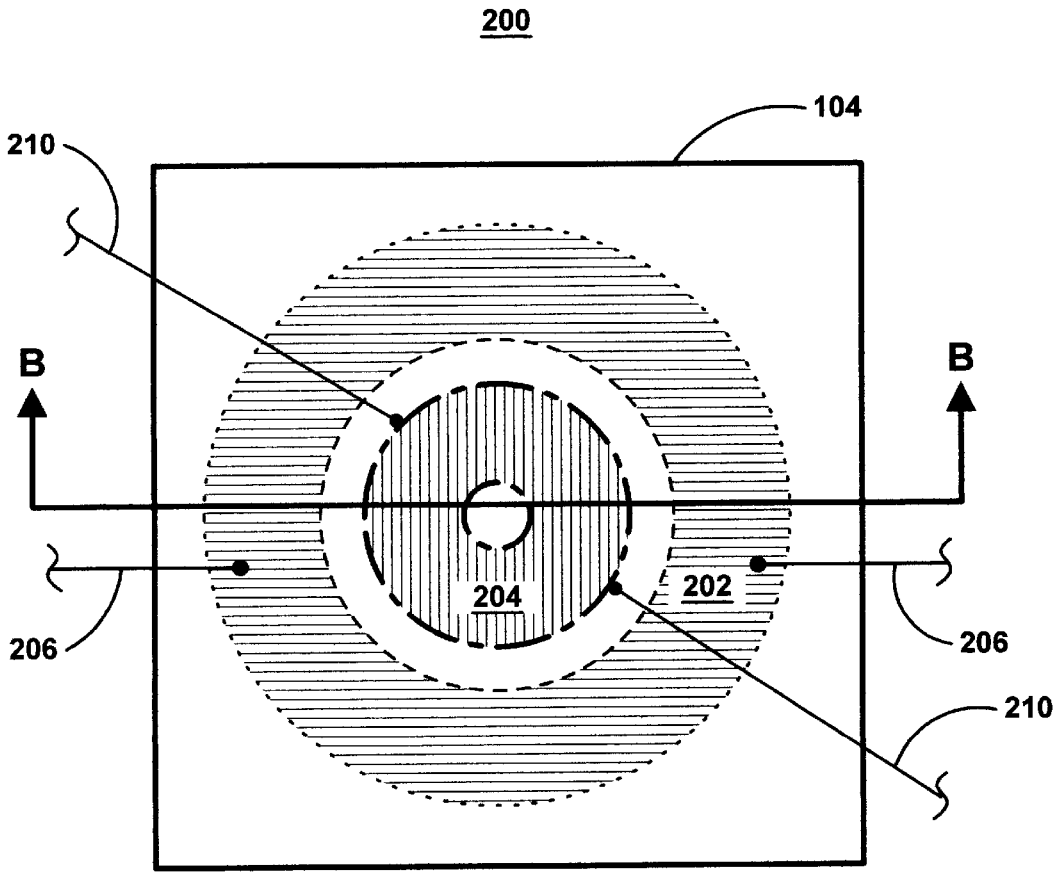
FIG. 2A is a cross-sectional top view of an improved electrochemical cell system used for electroplating a semiconductor wafer, in accordance with one embodiment of the present invention.

FIG. 2A presents a cross-sectional top view of an improved electrochemical cell system used for electroplating a semiconductor wafer, in accordance with one embodiment of the present invention. The cross-sectional top view is applicable to portions of subsequent figures, FIG. 2B and FIG. 2C as noted in the drawings. The cross-sectional top view shows chamber 104 enclosing a first anode 202 and a second anode 204. While anodes 202 and 204 are illustrated as two coaxial annular rings, the present invention is equally well suited to alternative embodiments that provide a capability for variable currents to semiconductor wafer 102 cathode. For example, the anode could be constructed of more or less annular rings or of rectangular bars, a grid, etc. Section B-B is illustrated as passing approximately through the center of both coaxial annular ring anodes 202 and 204. Leads 206 are coupled to first anode 202, while leads 210 are coupled to second anode 204. While the present invention illustrates the use of multiple leads coupled at specific locations on the anode, the present invention is equally well suited to alternative configurations using more or less leads coupled to different locations on anodes.

Figure 2B:
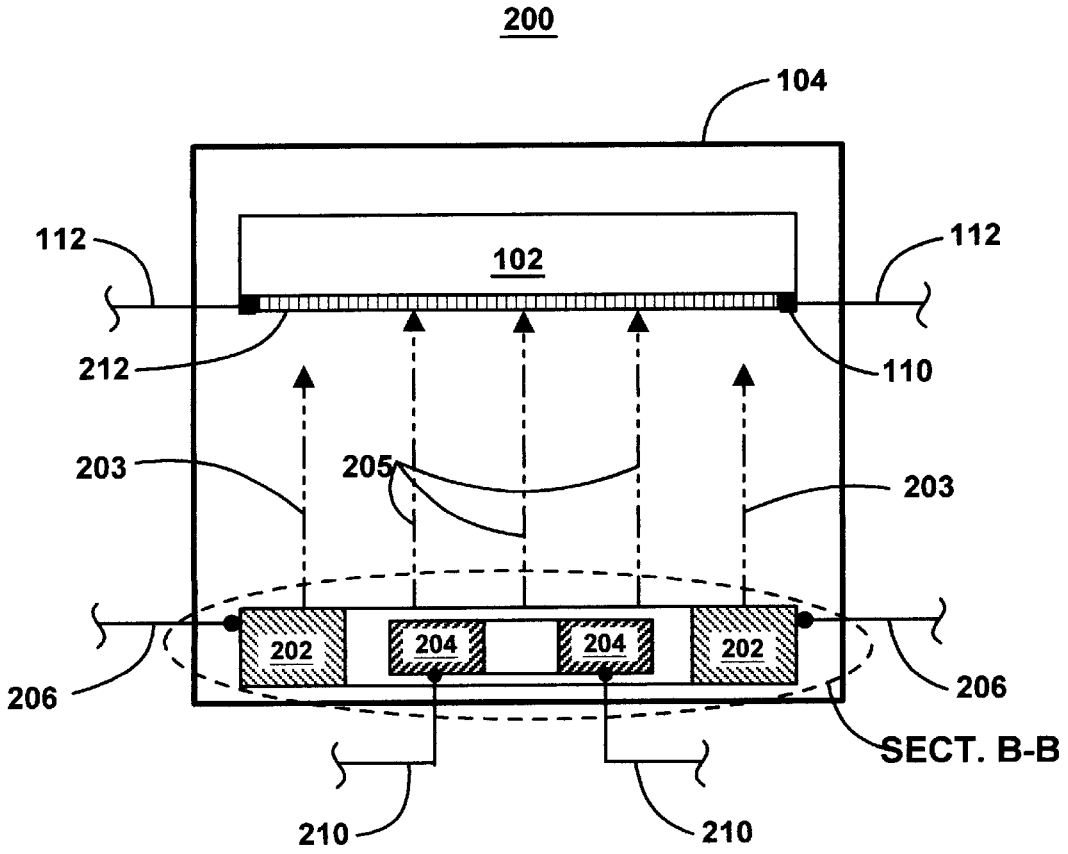
FIG. 2B is a side view of a first improved electrochemical cell system shown in FIG. 2A, in accordance with one embodiment of the present invention.

FIG. 2B presents a side view of a first improved electrochemical cell system, as partially illustrated in FIG. 2A, in accordance with one embodiment of the present invention. The side view illustrates some features more clearly. For example, electroplated film 212 is more clearly illustrated as a flat and uniform film due to the improvements provided in the present invention. Electrical current is represented by electric current flux lines in the figures. Electric flux lines 205 generated by anode 204 and electrical current flux lines 203 generated by anode 202 have different dimensions to pictorially illustrate the varying strengths of the flux. While the present embodiment illustrates stronger flux lines 205 from anode 204 in the center of semiconductor wafer 102 with respect to the flux lines 203 from anode 202 at the outer diameter of semiconductor wafer 102, the present invention is equally well suited to alternative variations in the electrical current flux as applicable per the variables noted hereinafter and per specific applications.

Figure 2C:
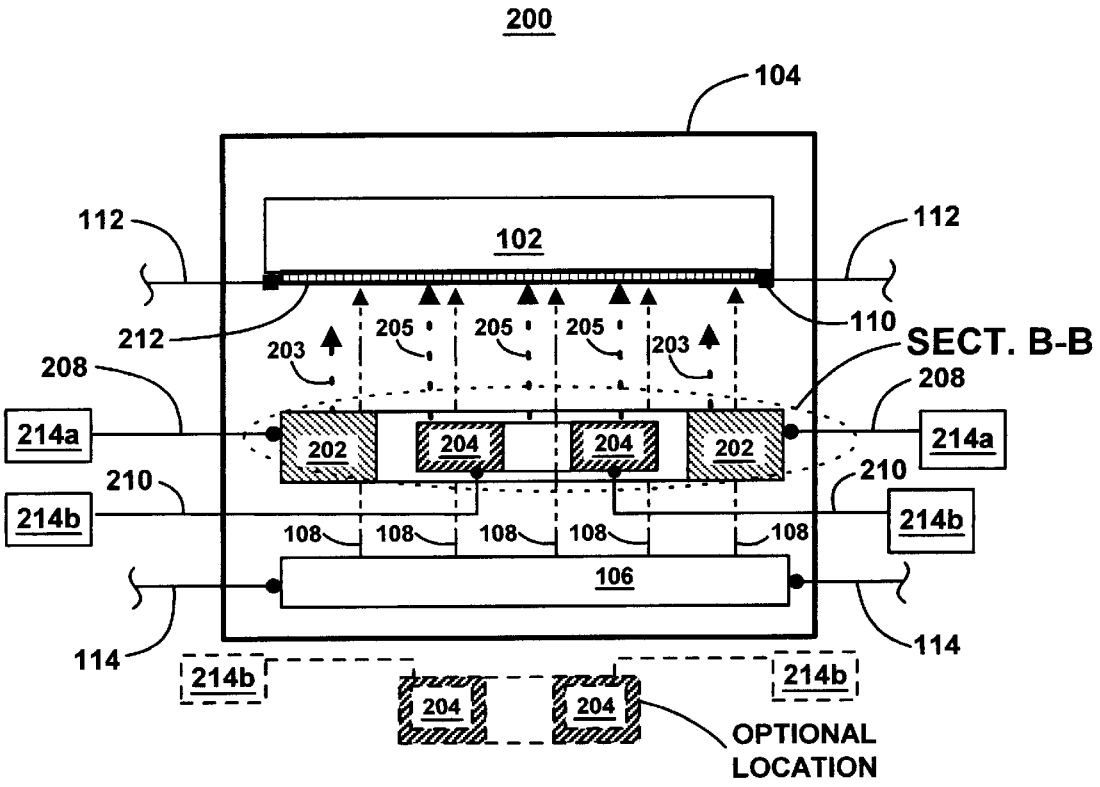
FIG. 2C is a side view of a second improved electrochemical cell system shown in FIG. 2A, in accordance with one embodiment of the present invention.

FIG. 2C presents a side view of a second improved electrochemical cell system, as partially illustrated in FIG. 2A, in accordance with one embodiment of the present invention. In this configuration, anodes 202 and 204 are used as secondary anodes while anode 106 is used as a primary anode. That is, primary anode 106 provides a theoretically constant current to semiconductor wafer cathode 102 while secondary anodes 202 and 204 provide a variable current represented by current flux lines 203 and 205, respectively, to semiconductor wafer cathode 102. In this manner, variable current represented by current flux lines 203 and 205 from secondary anodes 202 and 204 provide a current that compensates for all the variables that alter and distort current 108 from primary anode 106. While the present embodiment illustrates a specific number, location, and geometric shape of secondary anodes 202 and 204, the present invention is equally well suited to alternative configurations, quantities, and placement of secondary anodes. Each secondary anode 202 and 204 are coupled separately via leads 208 and 210, respectively, to Power Supplies 214*a* and 214*b,* respectively. The present invention is also suited to alternative configurations of power supply that can provide variable current via any feasible means such as variable voltage or variable resistance.

While the prior embodiments illustrate anodes 106, 202, and 204 as located within chamber 104 of electrochemical cell 200, the present invention is also well suited to alternative designs. For example, one or more anodes could be placed outside of chamber 104, and thereby modify the current flux inductively.

By utilizing the present invention, as illustrated in the present embodiments, the film formed on semiconductor wafer has a more uniform thickness and surface than that provided by the conventional method and apparatus.

Figure 3:
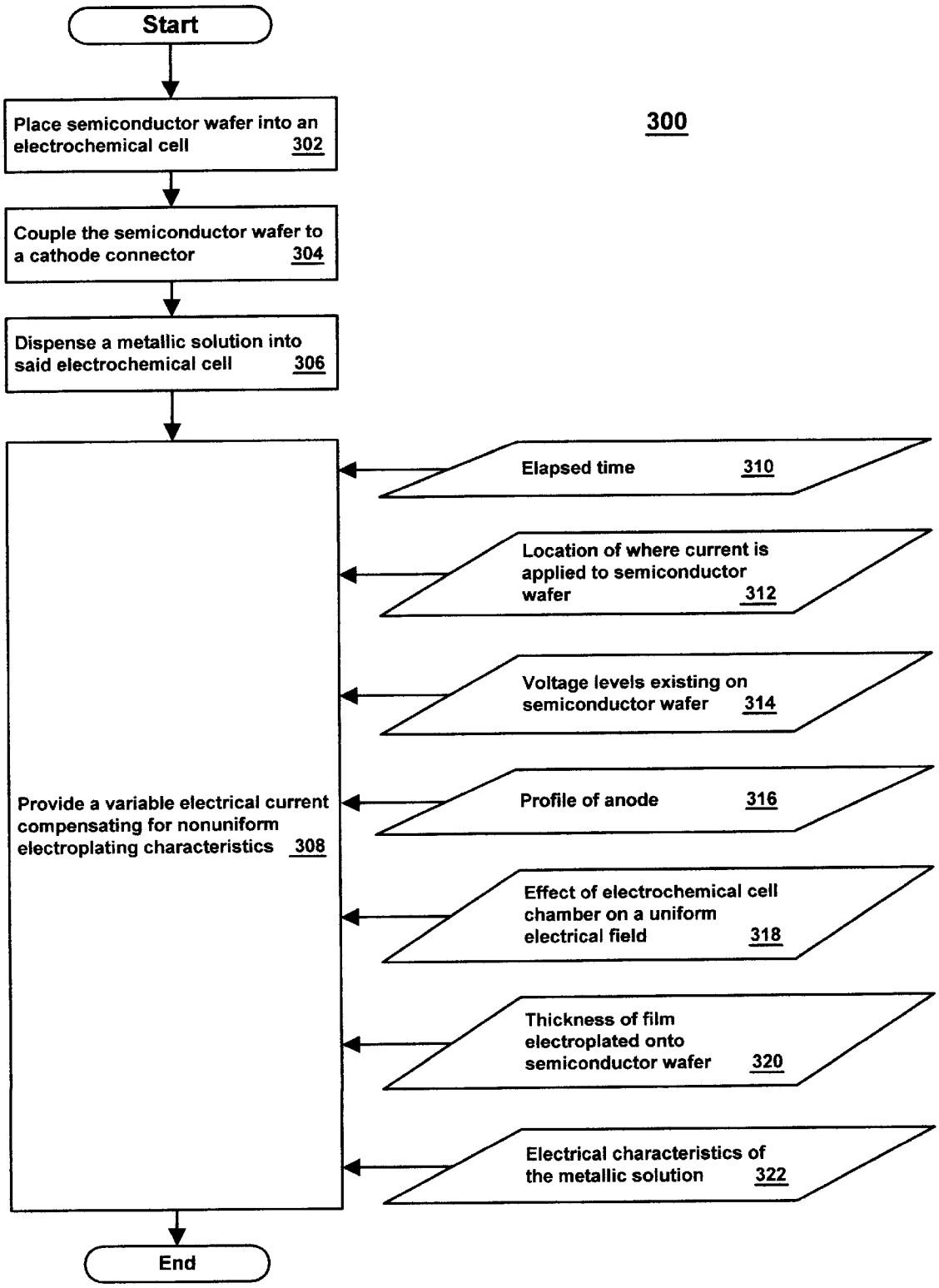
FIG. 3 is a flow chart of the steps performed to provide an improved electroplated film, via optimized electrical current, on a semiconductor wafer, in accordance with one embodiment of the present invention.

FIG. 3 presents a flow chart 300 of the steps performed to provide an improved electroplated film, via optimized electrical current, on a semiconductor wafer, is presented in, in accordance with one embodiment of the present invention. The steps presented in flowchart 300 will be described with reference to the hardware illustrated in FIG. 2A, 2B, and 2C described hereinabove. The steps presented herein result in an improved film thickness and surface for an electroplated semiconductor wafer, as compared to the conventional steps.

In step 302, a semiconductor wafer is placed into an electrochemical cell. As illustrated in FIG. 2A, 2B and 2C, semiconductor wafer 102 is placed into electrochemical cell 100. Once inside, it acts as the cathode of electrochemical cell 100.

In step 304, the semiconductor wafer is coupled to cathode contact. As illustrated in FIG. 2B and 2C, semiconductor wafer 102 is coupled to cathode contacts 110, which is subsequently coupled to leads 102. In th is manner, semiconductor wafer 102 is electrically coupled so as to act as a cathode in the electroplating operation.

In step 306, a metallic solution is dispensed into the electrochemical cell. The metallic solution contains the metal that is desired to be electroplated onto the semiconductor wafer. The metallic solution is not illustrated in any figure, per se, but it is understood that metallic solution is disposed within electrochemical cell and is in contact with both the anode and the cathode. As an example, one type of metallic solution is copper sulfate, used to electroplate copper onto a semiconductor wafer.

In step 308, a variable electrical current that compensates for nonuniform electroplating characteristics is provided. Several inputs are provided into step 308 so as to accomplish the goal of varying the electrical current. Specifically, input 310 provides an elapsed time over which the electrical current can be varied. Similarly, input 312 provides locations where the electrical current is applied to the semiconductor wafer so that the current may be varied depending upon its location. Input 314 provides voltage levels existing at different locations on the semiconductor wafer so that the current may be varied depending upon the voltages and their locations. Next, input 316 provides a profile of an anode so that electrical current can be varied with respect to the anode profile. With input 318 the effect of the electrochemical cell chamber on a uniform electrical field is input so it may be reduced. Input 320 provides the thickness of electroplated film on the semiconductor wafer so that the current may be varied according to the thickness. Finally, input 322 provides electrical characteristics of the metallic solution so electrical current can be varied with respect to these characteristics.

The foregoing descriptions of specific embodiments of the present invention have beer presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in he art to best utilize the invention and various embodiments with various modifications as are suited to the particular use contemplated. It is intended that the scope of the invention be defined by the Claims appended hereto and their equivalents.

What is claimed is:

1. A system for electroplating a layer of material on a semiconductor wafer, said system comprising:

an electrochemical cell, said electrochemical cell comprising a primary anode, a cathode contact, and a chamber, said primary anode and said cathode contact disposed within said chamber;

at least one secondary anode, said secondary anode for providing a variable current to said semiconductor wafer;

a metallic solution, said metallic solution disposed within said electrochemical cell; and a power source, said power source coupled to said primary anode, to said at least one said secondary anode and to said cathode contact, said power source capable of producing said variable current by providing varying levels of voltage to said primary anode and to said secondary anode.

2. The system as recited in claim 1 wherein said at least one secondary anode is disposed outside of said electrochemical cell.

3. The system as recited in claim 1 wherein said at least one secondary anode is a ring shaped anode.

4. The system as recited in claim 1 wherein said at least one secondary anode is disposed between said primary anode and said semiconductor wafer.

5. The system as recited in claim 1 wherein said at least one secondary anode is comprised of a first secondary anode and a second secondary anode.

6. The system as recited in claim 5 wherein said first secondary anode and said second secondary anode are comprised of a first concentric ring and a second concentric ring.

7. The system as recited in claim 1 further comprising:

a semiconductor wafer, said semiconductor wafer coupled to said cathode contact, said semiconductor wafer acting as a cathode and thereby receiving an electroplated film on its surface.

8. The system recited in claim 1 wherein said at least one secondary anode is disposed within said chamber of said electrochemical cell.

9. The system recited in claim 1 wherein said metallic solution is a copper solution.

10. The system recited in claim 1 wherein said power source provides said variable electrical current as a function of respect to elapsed time of said electroplating operation.

11. The system recited in claim 1 wherein said power source provides said variable electrical current as a function of physical location of application of said variable electrical current to said semiconductor wafer.

12. The system recited in claim 1 wherein said power source provides said variable electrical current as a function of respect to a voltage that exists at discrete locations on said semiconductor wafer being electroplated.

13. The system recited in claim 1 wherein said power source provides said variable electrical current as a function of variation in a profile of said primary anode and at least said at least one secondary anode used in said electroplating operation.

14. The system recited in claim 1 wherein said power source provides said variable electrical current as a function of an influence of said chamber of said electrochemical cell on a theoretically uniform electric field.

15. The system recited in claim 1 wherein said power source provides said variable electrical current as a function of a thickness of said layer of material electroplated onto said semiconductor wafer.

16. The system recited in claim 1 wherein said power source provides a lower current value at an outer portion of said semiconductor wafer and wherein said power source provides a higher current value at an inner portion of said semiconductor wafer.

17. The system recited in claim 1 wherein said power source includes a first current source having an approximately constant current and a second current source having a variable current.

18. The system recited in claim 9 wherein said power source provides said variable electrical current as a function of electrical characteristics of said metallic solution used in said electroplating operation.

19. The system recited in claim 1 wherein said power source provides said variable electrical current by providing a variable voltage across said primary anode and said cathode and by providing a variable voltage across said at least one secondary anode and said cathode.

20. The system recited in claim 1 wherein said power source provides said variable electrical current by providing a variable voltage across said primary anode with respect to said at least one secondary anode.

21. An anode system for performing an electroplating operation, said anode system comprising:

a plurality of anodes, said plurality of anodes for performing an electroplating operation on a part, said plurality of anodes insulatively coupled together, said electroplating operation controlled by providing a variable current on said plurality of anodes via varying levels of voltage; and a plurality of leads, each of said plurality of leads respectively coupled to one of said plurality of anodes, each of said plurality of leads insulatively coupled to any other said plurality of leads such that each of said plurality of leads has the capability of providing an independent electrical current from a power source to its respective one of said plurality of anodes.

22. The anode system recited in claim 21 wherein at least one of said plurality of anodes is disposed outside of an electrochemical cell, said at least one of said plurality of anodes influencing an electrical field for said electroplating operation.

23. The anode system recited in claim 21 wherein at least one of said plurality of anodes is a ring-shaped anode.

24. The anode system recited in claim 21 wherein at least one of said plurality of anodes is disposed annularly within at least another of said plurality of anodes.

* * * * *